United States Patent [19]

Speiser et al.

[11] Patent Number: 5,065,549

[45] **Date of Patent: * Nov. 19, 1991**

[54] METHOD AND APPARATUS FOR MANUFACTURING K-FILES AND REAMERS

[75] Inventors: Robert D. Speiser, New York, N.Y.; Steven Bernstein, York, Pa.; Charles N. Miller, Spring Grove, Pa.; Dane Shearer, York, Pa.

[73] Assignee: Union Broach, York, Pa.

[ * ] Notice: The portion of the term of this patent subsequent to Mar. 19, 2008 has been disclaimed.

[21] Appl. No.: 624,865

[22] Filed: Dec. 10, 1990

Related U.S. Application Data

[63] Continuation of Ser. No. 363,691, Jun. 9, 1989, Pat. No. 4,999,952.

[51] Int. Cl.[5] ..... B24B 3/00; B24B 5/00

[52] U.S. Cl. ..... 51/288; 51/95 TG; 51/95 WH; 51/206 P; 51/94 CS

[58] Field of Search ..... 51/94 CS, 95 TG, 95 WH, 51/95 LH, 92 ND, 48 HE, 72, 74 R, 103, 105 CC, 219 R, 219 PC, 288, 206 P, 206 R

[56] References Cited

U.S. PATENT DOCUMENTS

| | | | |
|---|---|---|---|
| 1,670,479 | 5/1928 | Olson | 51/206 P |
| 1,702,160 | 2/1929 | Hanson | 51/206 P |
| 2,138,739 | 11/1938 | Harley | 51/288 |
| 3,554,606 | 1/1971 | Mabey et al. | 51/206 P |
| 3,561,171 | 2/1971 | Van Vleet et al. | 51/288 |
| 3,602,209 | 8/1971 | Bocker | 51/206 P |
| 4,068,414 | 1/1978 | Breitstein et al. | 51/95 LH |
| 4,546,575 | 10/1985 | Adams | 51/95 LH |
| 4,548,000 | 10/1985 | Junker | 51/206 P |
| 4,611,509 | 9/1986 | Matsutani | 51/288 |

FOREIGN PATENT DOCUMENTS

| | | |
|---|---|---|
| 2553018 | 10/1984 | France . |
| 469876 | 7/1937 | United Kingdom . |
| 2040743 | 9/1980 | United Kingdom . |

*Primary Examiner*—D. S. Meislin
*Assistant Examiner*—Blynn Shideler
*Attorney, Agent, or Firm*—Sughrue, Mion, Zinn, Macpeak & Seas

[57] ABSTRACT

A process and apparatus for grinding the proper taper and all of the flutes with the correct number of spirals simultaneously in a single cycle of the grinding machine. This is accomplished by passing a rotating stock to produce the correct number of spirals under a grinding wheel that is dressed with three or four properly formed ribs depending on how many flutes are being manufactured. These ribs are spaced so as to exactly match the lead distance of the rotating stock during 120° or 90° of revolution, depending on whether a three or four fluted instrument is being manufactured. The height of each individual rib on the grinding wheel varies in relationship with each other to exactly match the correct taper being created by moving either the rotating stock portion of the machine or the grinding wheel portion of the machine so as to increase the distance therebetween.

10 Claims, 1 Drawing Sheet

FIG. 1
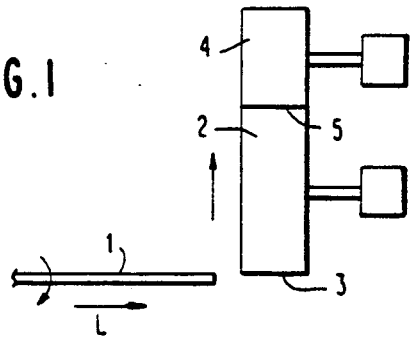
FIG. 2
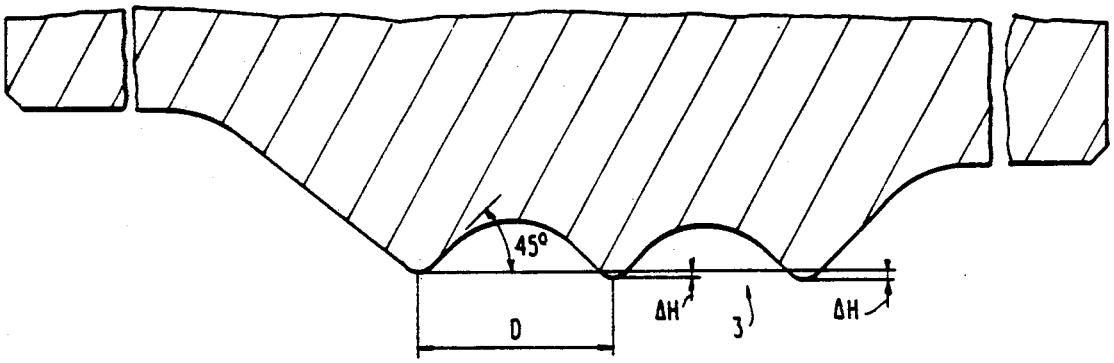
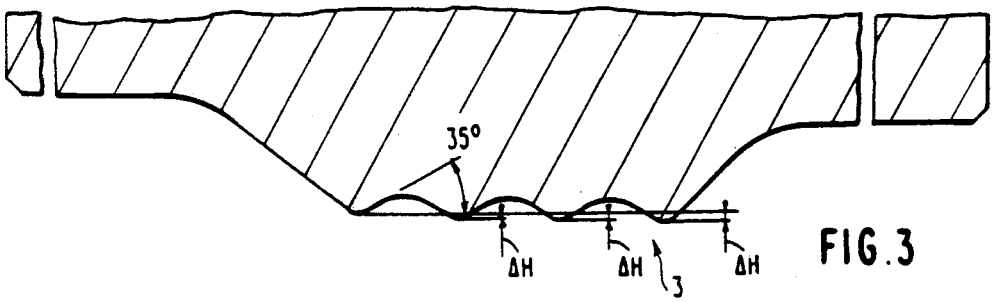
FIG. 3
FIG. 4
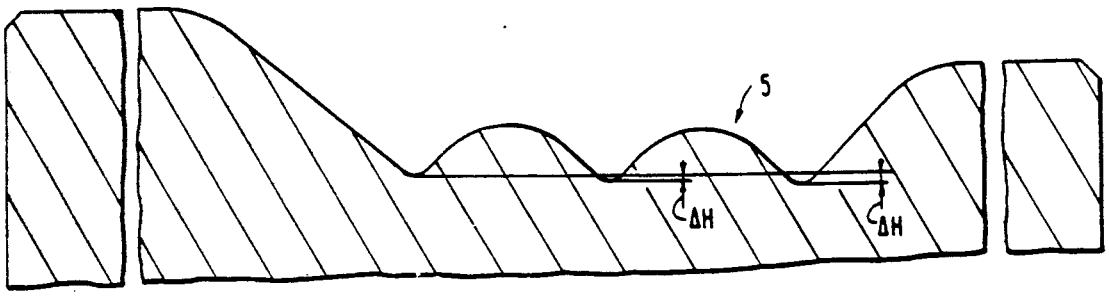

METHOD AND APPARATUS FOR MANUFACTURING K-FILES AND REAMERS

This is a continuation of application Ser. No. 363,691 filed June 9, 1989, now U.S. Pat. No. 4,999,952.

BACKGROUND OF THE INVENTION

1. Field of the Invention

This invention relates to a method and apparatus for manufacturing K-files and reamers for use in performing root canals.

2. Background

K-type files and reamers are used in the field of endodontics to clean the root canals of human teeth for the purpose of removing organic material and extraneous material and for enlarging the root canal so that it may be filled.

Industry standards for K-type files and reamers are defined by the American Dental Association (ADA). International Standards Organization (ISO). and Federal-Military Specifications. As defined by these organizations, K-type files and reamers range in size from 06 mm to 140 mm, corresponding to the diameter of the tip, and range in length from 21 mm to 31 mm. The total number of spirals varies depending on the size of the instrument and whether the instrument is a K-type file or a reamer: the reamer having fewer number of spirals than K-type files. The overall length of the spiralled portion of each instrument is a minimum of 16 mm and the diametric taper is 0.02 mm change in diameter per mm in length (0.02 mm/mm).

These instruments are presently manufactured by one of the following three processes. In the first process, the feed stock is ground on three or four sides thereof in a tapered manner to form either a triangular or rectangular bar, depending upon whether a three fluted or four fluted instrument is being manufactured. That is, a tapered triangular bar is shaped for a three fluted instrument while a tapered rectangular bar is ground for a four fluted instrument. Thereafter, the triangular or rectangular tapered bar is twisted to provide a proper number of spirals as required by the industry standards. According to the first process, the grinding operation can encompass either a cross-feed flat grinding operation or a longitudinal feed flat grinding operation.

In the second process, the feed stock is initially ground to create a tapered cylindrical bar for the fluted portion of the instrument. Thereafter, flutes are individually ground on the tapered portion of the instrument to produce either a three or four fluted instrument, as required. This is accomplished by passing a rotating instrument, driven by a lead screw or similar device that produces the correct number of spirals, under a properly dressed grinding wheel thereby generating a flute. The instrument is then retracted, indexed 120° or 90° depending upon whether a three or four fluted instrument is being manufactured, and the process is repeated until each of the flutes are machined.

The third process involves grinding the taper and each of the flutes of the instrument simultaneously on an individual basis. This is accomplished by passing a rotating stock driven by a lead screw or similar device to produce the correct number of spirals under a properly dressed grinding wheel thereby generating a single flute. While the flute is being generated, either the rotating portion of the machine or the grinding wheel portion of the machine is translated such that the distance therebetween is continuously increased to create the proper taper. After the first flute is completed, the instrument is retracted, indexed 120° or 90° depending upon whether a three or four fluted piece is being manufactured, and the process is repeated for each flute.

As can be seen from the foregoing, each of these known processes require a long manufacturing time since each of the flutes are formed on an individual basis. Further, since the same portion of the grinding wheel is used to grind all the flutes, the life of the grinding wheel is relatively short.

SUMMARY OF THE INVENTION

The object of the present invention is to substantially reduce the time required to manufacture K-files and reamers.

Another object of the invention is to provide a manufacturing process wherein the proper taper and all of the flutes with the correct number of spirals can be simultaneously machined in a single cycle of the machine.

Still a further object of the invention is to extend the life of the grinding wheel by eliminating the need to machine each flute individually using the same surface of the grinding wheel.

These and other objects which will become apparent from the ensuing description of the preferred embodiment of the invention are accomplished by a process comprising the steps of rotating a grinding wheel; feeding a rotating stock in the longitudinal direction with respect thereto, the axes of rotation of the grinding wheel and the bar stock being disposed parallel to one another; and simultaneously translating either the grinding wheel or the bar stock such that the distance therebetween increases as the stock is fed so as to form the proper taper, wherein the grinding wheel has a circumferentially disposed grinding surface having a plurality of ribs formed along the perimeter thereof, the number of ribs corresponding to the number of flutes being formed and the ribs being spaced apart by a distance corresponding to the lead distance the stock is fed over the period of rotating the stock an angle of 360° divided by the number of flutes being formed, and wherein the difference in height between each of the ribs corresponds to the degree of taper of the desired instrument. In this manner, the proper taper and all of the flutes with the correct number of spirals can be simultaneously machined in a single cycle. Therefore, the manufacturing time is reduced by at least two-thirds over any of the other known processes and the life of the grinding wheel can be substantially extended because each rib on the grinding wheel cuts a single flute, whereas according to all of the known processes the same surface of the grinding wheel was used to cut each and every flute.

BRIEF DESCRIPTION OF THE DRAWINGS

FIG. 1 is a schematic illustrating the method and apparatus for manufacturing K-file and reamer instruments according to the invention;

FIG. 2 is a detailed view illustrating the grinding surface of the grinding wheel for manufacturing a three fluted instrument;

FIG. 3 is a detailed view illustrating the grinding surface of a grinding wheel for manufacturing a four fluted instrument; and FIG. 4 is a detailed view illustrating the dressing surface of the dressing wheel according to the invention.

DETAILED DESCRIPTION OF THE PREFERRED EMBODIMENTS

FIG. 1 illustrates the process of manufacturing three and four fluted K-files and reamers. The process involves grinding the proper taper and all of the flutes with the correct number of spirals simultaneously, in a single cycle of the machine.

As shown in FIG. 1. a feed stock is simultaneously rotated and fed in a feed direction towards a rotating grinding wheel 2 using a lead screw or the like. The feed distance in which the stock is fed per revolution of the screw is referred to as the lead L. The grinding wheel 2 has a disk-like shape and is disposed in such a manner that the axis of rotation of the grinding wheel is parallel to the axis of rotation of the feed stock 1.

The grinding wheel 2 has a grinding surface 3 disposed along the circumference thereof. FIGS. 2 and 3 illustrate the contour of the grinding surface of grinding wheels for manufacturing instruments of various sizes as defined by the International Standards Organization (ISO), American Dental Association (ADA) and Federal-Military Specifications. In particular. FIG. 2 illustrates the surface of the grinding wheel for manufacturing three fluted instruments; and FIG. 3 illustrates the grinding surface for manufacturing four fluted instruments.

Referring first to FIG. 2, the grinding surface has three ribs disposed thereon corresponding to the number of flutes on a three fluted K-file. As shown in FIG. 2, the ribs are separated from one another by a distance D which represents the lead distance of the rotating stock during 120° of revolution. Correspondingly, the distance D equals the distance between spirals on a particular instrument to be manufactured. Thus, the distance D between adjacent ribs is determined based on the number of spirals S required on a given size file and the corresponding length l of the spiralled portion of the instrument, as defined by the following equation:

$$D=l/S$$

For example, as defined by the Federal-Military Specifications, for a standard K-file size 45 mm the number of spirals over a length of 0.630 inches (16 mm) is 21. Accordingly, the distance D between ribs on the perimeter of the grinding wheel is:

$$D=0.630/21=0.030 \text{ inches.}$$

As stated above, the lead L corresponds to the distance in which the feed stock is fed in a single revolution. Since, by definition, the number of spirals per revolution corresponds to the number of flutes $N_f$, the relationship between the lead L and the distance between ribs D is as follows:

$$L=D\times N_f$$

Thus, for example, the lead L for the size 45 mm, three-fluted instrument is:

$$L=0.030\times 3=0.090 \text{ inches/revolution.}$$

To form the proper taper on the file as defined by the ISO and ADA, adjacent ribs have a difference in height ΔH corresponding to the specific taper required on the instrument being manufactured. Accordingly, the difference in height of adjacent ribs is calculated as follows:

$$H=T\times D/2,$$

where T is the required taper and D is the distance between adjacent ribs, as defined above. For examples, as stated in the Background portion of the application, the standard taper on K-type files and reamers is 0.02 mm per mm of length (0.02 mm/mm). Accordingly, for a size 45 instrument where the distance between adjacent ribs is 0.030 inches, the difference in height is:

$$\Delta H=0.02\times 0.030/2=0.0003$$

In the process of manufacturing the instruments, the proper taper is formed by translating either the rotating stock portion of the machine or the grinding wheel portion of the machine so as to continuously increase the distance therebetween as the feed stock is simultaneously rotated and fed during the fluting operation. Since the outer diameter of the instrument is generated during the fluting process, rather than being specifically machined to dimension prior to the fluting operation as in the prior art processes, the back-out rate at which either the grinding wheel or the feed stock is translated is determined experimentally.

The back-out rate is a function of the other parameters discussed above such as the distance between ribs D, the lead 1 and the difference in height between adjacent ribs ΔH. The back-out rate effects the final diameter and taper of the instrument.

For the purpose of illustration, table 1 provides the parameters for manufacturing standard K-type files and reamers of size 45 mm having three flutes. As shown therein, the back-out rate at which the grinder or the feed stock is translated is 0.0053 inches for each inch in which the stock is fed by the lead screw. That is, the back-out rate is 0.0053 in./in.

K-TYPE FILES AND REAMERS OF SIZE 45 mm HAVING THREE FLUTES

| | |
|---|---|
| Spirals/Length: | 21/16 mm (.630 in.) |
| Distance between Ribs: | .0303 in. |
| Lead: | .0909 in. |
| Required Taper: | .02 mm/mm |
| Backout Rate: | .0053 in./in. |
| ΔH difference in Height of Ribs | .00030 in. |

Referring again to FIG. 1, a dressing wheel 4 is provided for dressing the surface of the grinding wheel so as to maintain the required shape, discussed above. FIG. 4 illustrates the surface 5 of a dressing wheel to be used when manufacturing a three-fluted instrument. As shown therein, the surface 5 of the dressing wheel is complimentary to the surface 3 of the grinding wheel for forming a grinding surface having three ribs.

Although the present invention has been described with reference to an instrument of size 45 mm, it should be understood that the other standard size instruments can be manufactured using the process and grinding wheel described hereinabove without departing from the spirit of the invention.

Accordingly, the present invention provides a manufacturing process and a grinding wheel for manufacturing K-type files and reamers where the manufacturing time is reduced by at least two-thirds over any other known processes and where the life of the grinding wheel can be significantly extended.

What is claimed is:

1. A process of producing a dental instrument having a plurality of flutes each with a predetermined number of spirals over a predetermined length of the instrument, and having a predetermined taper, the method comprising the steps of:

providing a single grinding wheel having a plurality of grinding ribs extending from a periphery thereof;

rotating said grinding wheel about a first axis;

feeding, along a second axis, a rotating bar stock past the plurality of grinding ribs so as to grind said bar stock; and simultaneously with said feeding step translating one of said grinding wheel and said bar stock such that a distance between the first and second axes increases as said bar stock is fed, and such that a single pass of said bar stock by the plurality of grinding ribs of said single grinding wheel produces the multi-fluted tapered dental instrument.

2. The process as defined in claim 1, wherein said providing step includes providing each of said plurality of ribs with a different height, the different heights of said ribs corresponding to a degree of taper of said dental instrument.

3. The process as defined in claim 1, wherein said feeding step feeds said rotating bar stock at a lead which corresponds to a distance said rotating bar stock is fed in a single revolution thereof.

4. The process as defined in claim 1, wherein said feeding step feeds said bar stock such that said second axis is parallel to said first axis.

5. The process as defined in claim 1, wherein said process produces one of a K-type file and a reamer dental instrument.

6. An apparatus for producing a dental instrument having a plurality of flutes each with a predetermined number of spirals, and having a predetermined taper, the apparatus comprising:

a single grinding wheel having a plurality of grinding ribs extending from a periphery thereof;

means for rotating said grinding wheel about a first axis;

means for feeding, along a second axis, a rotating bar stock past the plurality of ribs of said grinding wheel so as to grind said bar stock; and means for translating one of said grinding wheel and said bar stock such that a distance between said first and second axes increases as said bar stock is fed, and such that a single pass of said bar stock by the plurality of ribs of said single grinding wheel produces the multi-fluted tapered dental instrument.

7. The apparatus as defied in claim 6, wherein said first and second axes are parallel to each other.

8. The apparatus as defined in claim 6, wherein each of said plurality of ribs has a different height, the different heights of said ribs corresponding to a degree of taper of said dental instrument.

9. The apparatus as defined in claim 6, wherein said feeding means feeds said rotating bar stock at a lead which corresponds to a distance said rotating bar stock is fed in a single revolution thereof.

10. The apparatus as defined in claim 6, wherein said dental instrument is one of a K-type file and a reamer dental instrument.

* * * * *